US005974001A

United States Patent [19]

Barton

[11] Patent Number: 5,974,001

[45] Date of Patent: Oct. 26, 1999

[54] MOON PHASE DEVICE

[76] Inventor: Sean Anderson Barton, Rte. 1 Box 118A, Bristol, Fla. 32321

[21] Appl. No.: 09/192,392

[22] Filed: Nov. 16, 1998

Related U.S. Application Data

[60] Provisional application No. 60/065,873, Nov. 17, 1997.

[51] Int. Cl.[6] ..... G04B 19/26

[52] U.S. Cl. ..... 368/18

[58] Field of Search ..... 368/15–20; 116/308, 116/321, 323; 289/2, 3

[56] References Cited

U.S. PATENT DOCUMENTS

| | | | |
|---|---|---|---|
| D. 254,124 | 2/1980 | Greenfield | D10/6 |
| 1,416,605 | 5/1922 | Bulka . | |
| 4,684,260 | 8/1987 | Jäckle | 368/16 |
| 4,692,031 | 9/1987 | Kaneko et al. | 368/18 |
| 5,086,416 | 2/1992 | Dubois et al. | 368/18 |
| 5,208,790 | 5/1993 | Sato | 368/15 |
| 5,731,573 | 3/1998 | Allen et al. | 235/78 R |

*Primary Examiner*—Vit Miska
*Attorney, Agent, or Firm*—Peter Loffler

[57] ABSTRACT

A moon phase device for determining the moon phase of a particular date, BC or AD, new style date or old style date, has six tube members adapted to move relative to each other. The first tube member has a first side with indicia thereon for representing the moon phases and a second side with indicia for representing the thousands of the year. The second tube member has a third side with a first indicator for selecting the thousands year and a fourth side with indicia for representing the hundreds of the year. The third tube member has a fifth side with a second indicator for selecting the hundreds year and a sixth side with indicia for representing the tens of the year. The fourth tube member has a seventh side with a third indicator for selecting the tens year and a eighth side with indicia for representing the single digit of the year. The fifth tube member has a ninth side with a fourth indicator for selecting the single digit of the year and a tenth side with indicia for representing the month. The sixth tube member has an eleventh side with a fifth indicator for selecting the month year and a twelfth side having day indicia for aligning with the moon phase indicia.

10 Claims, 8 Drawing Sheets

MOON PHASE DEVICE

This application claims benefit of provisional application Ser. No. 60,065,873, filed Nov. 17, 1997.

BACKGROUND OF THE INVENTION

1. Field of the Invention

The present invention relates to moon phase device for manually calculating the moon phase of a particular date.

2. Background of the Prior Art

Moon phase devices or astronomical clocks that determine the moon phase for a particular date are known in the art. U.S. Pat. No. 4,692,031 to Kaneko et al., U.S. Pat. No. D254,124 to Greenfield, and U.S. Pat. No. 4,684,260 to Jackle are examples of devices that are capable of such a task. However, the problem with these devices is that they are relatively complex machines that are complex in design and are relatively expensive to manufacture and maintain.

Therefore, there is a need in the art for a device that can quickly and accurately determine the moon phase of a particular date, such that the device is not unduly complex and is relatively inexpensive to build. Such a device should be relatively simple to operate and should be able to calculate moon phases for dates past, present, and future.

SUMMARY OF THE INVENTION

The moon phase device of the present invention addresses the aforementioned needs in the art. The moon phase device provides for a device that accurately calculates the moon phase for a particular date, AD or BC, old style date or new style date, past, present, or future, and is of relatively simple design and construction and is relatively easy to use.

The moon phase device is comprised of a first tube member has a first side with indicia thereon for representing the moon phases and a second side with indicia for representing the thousands of the year. The second tube member has a third side with a first indicator for selecting the thousands year and a fourth side with indicia for representing the hundreds of the year. The third tube member has a fifth side with a second indicator for selecting the hundreds year and a sixth side with indicia for representing the tens of the year. The fourth tube member has a seventh side with a third indicator for selecting the tens year and an eighth side with indicia for representing the single digit of the year. The fifth tube member has a ninth side with a fourth indicator for selecting the single digit of the year and a tenth side with indicia for representing the month. The sixth tube member has an eleventh side with a fifth indicator for selecting the month year and a twelfth side having day indicia for aligning with the moon phase indicia. The fifth indicator may have a plurality of gradations thereon, each gradation corresponding to a particular time zone. At least one band can be used to encompass the first through sixth tube members in order to allow them to move relative to each other.

BRIEF DESCRIPTION OF THE DRAWINGS

Similar reference numerals refer to similar parts throughout the several views of the drawings.

DESCRIPTION OF THE PREFERRED EMBODIMENT

Figure 1:
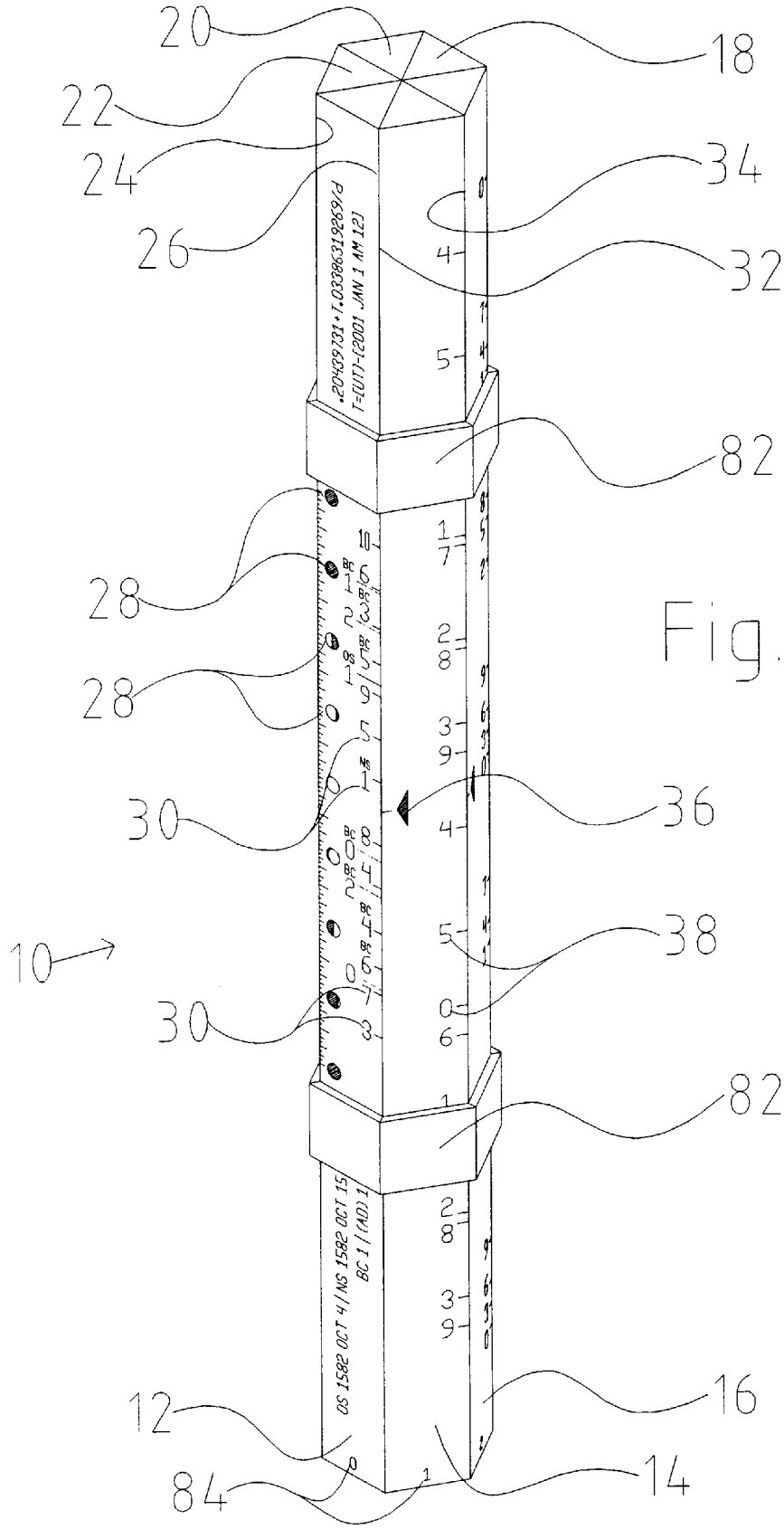
FIG. 1 is a perspective view of the moon phase device.
Figure 2:
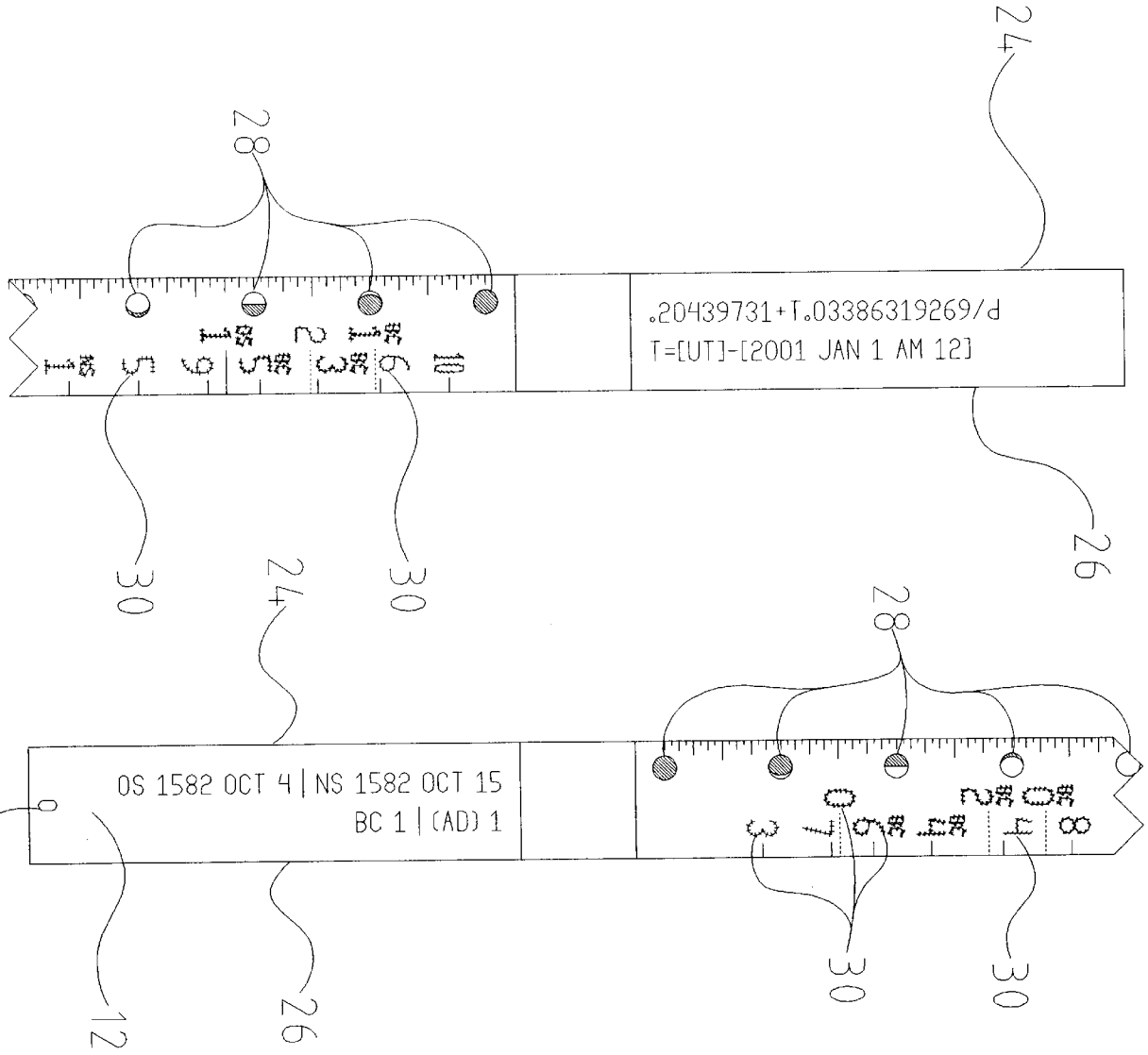
FIG. 2 is a front elevation view of the first tube member of the moon phase device.
Figure 3:
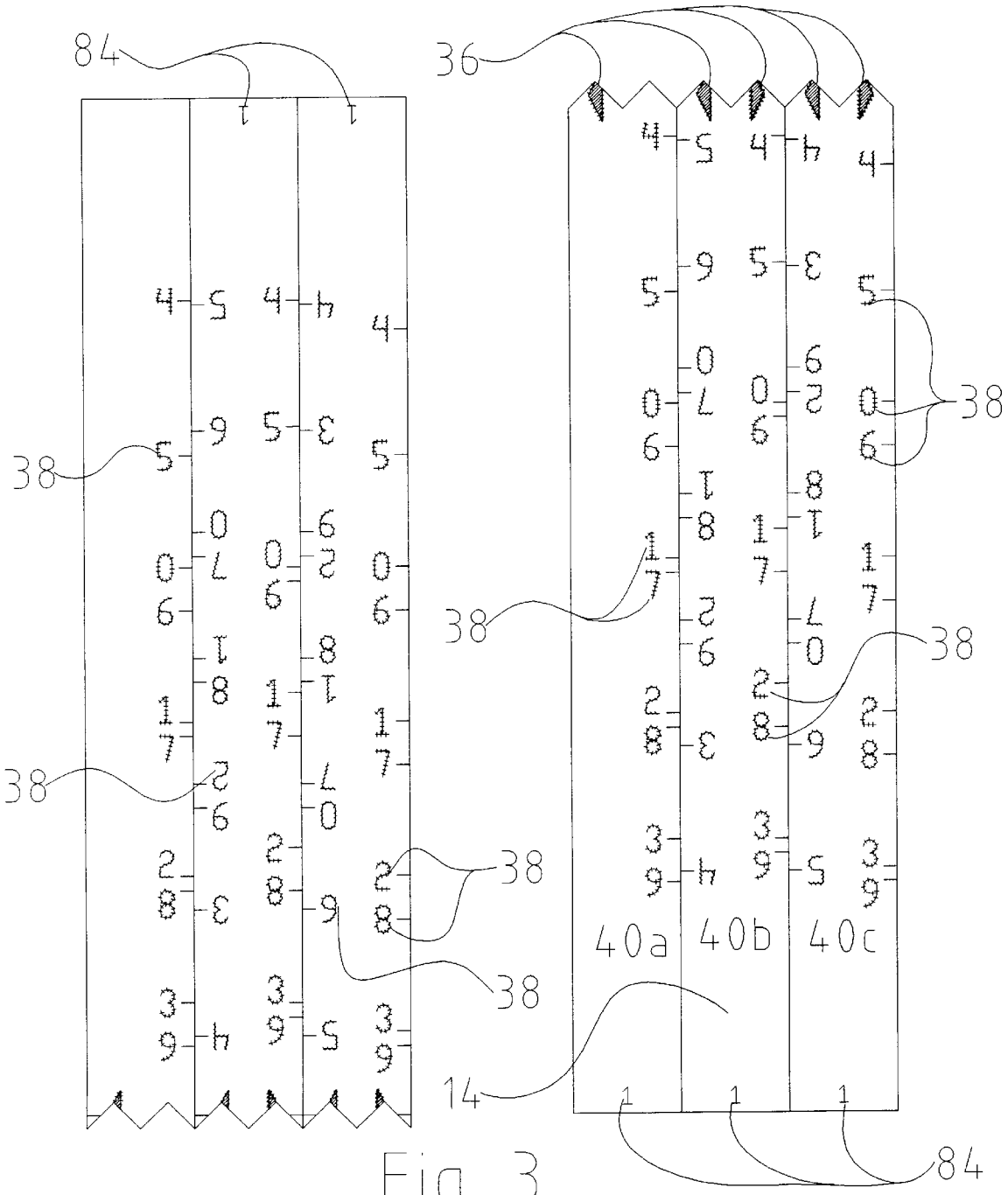
FIG. 3 is a front elevation view, flattened, of the second tube member of the moon phase device.
Figure 4:
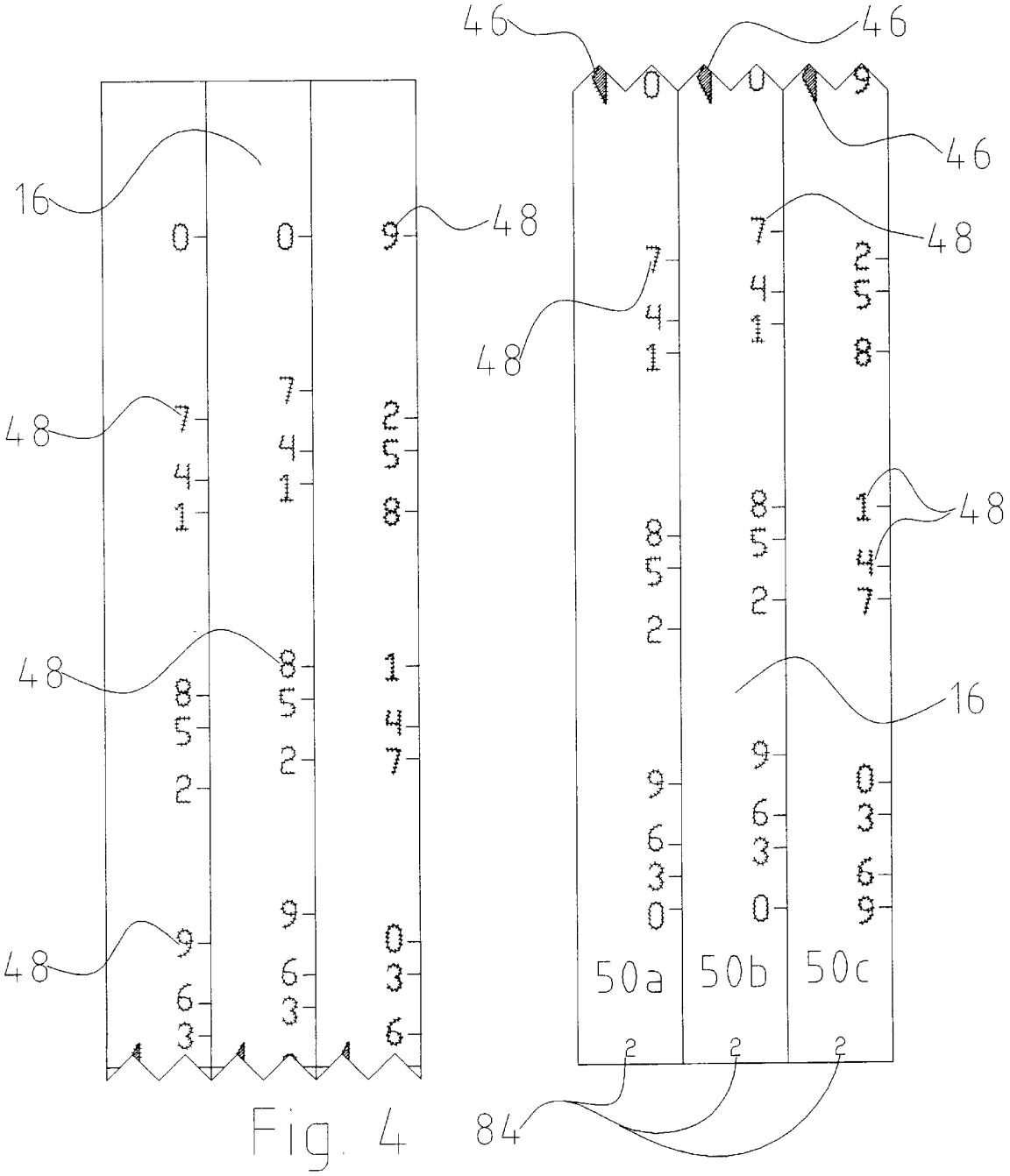
FIG. 4 is a front elevation view, flattened, of the third tube member of the moon phase device.
Figure 5:
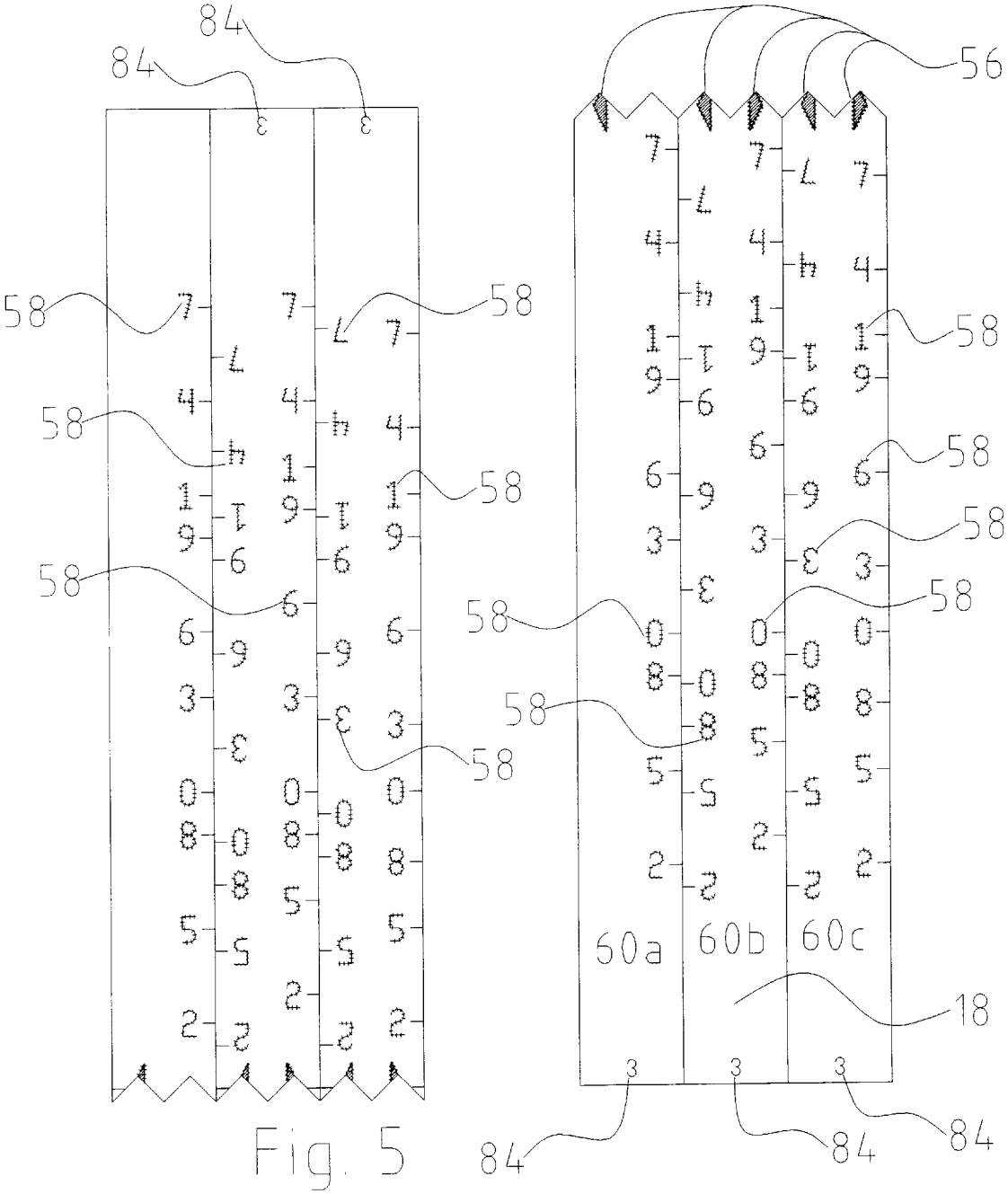
FIG. 5 is a front elevation view, flattened, of the fourth tube member of the moon phase device.
Figure 6:
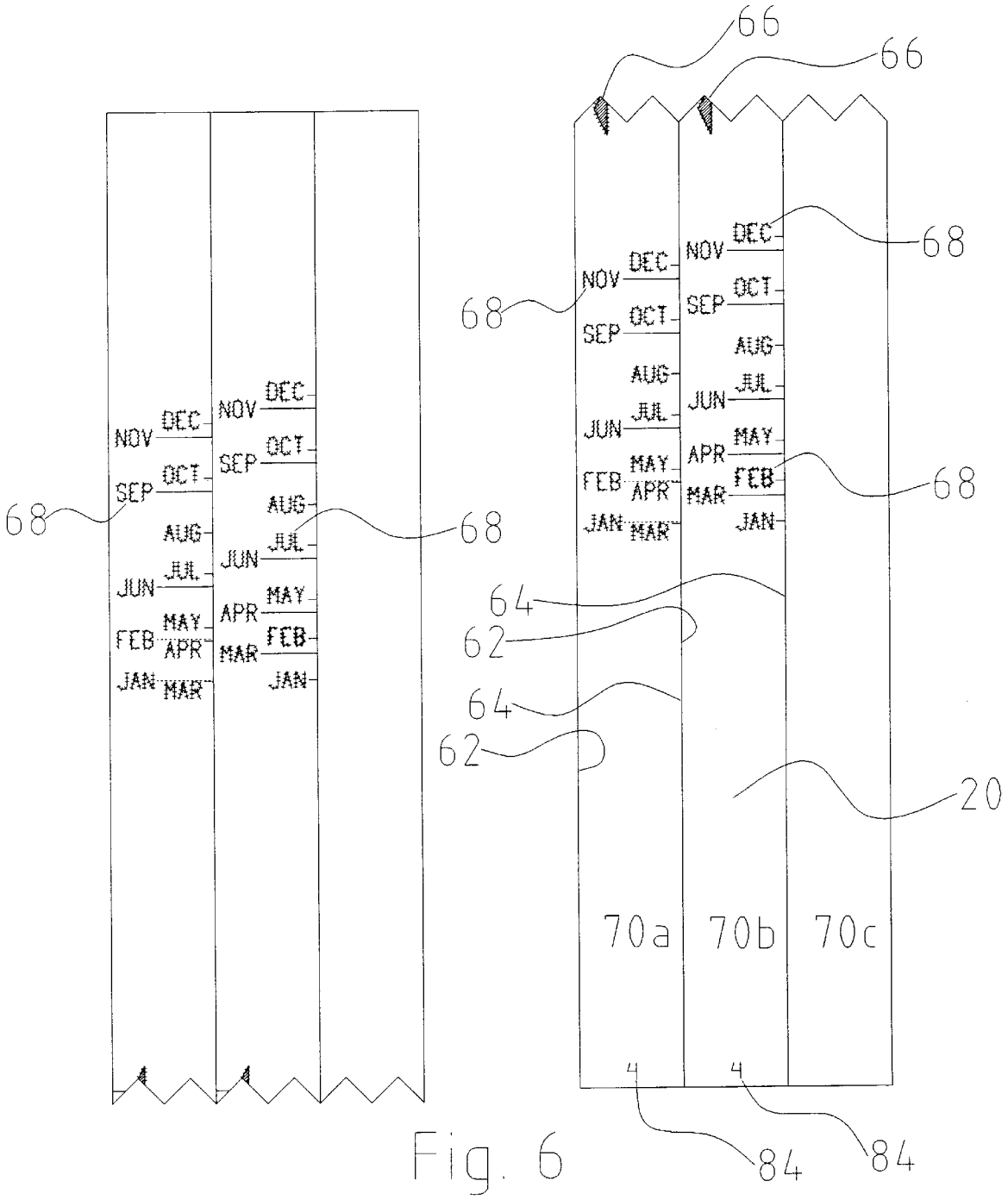
FIG. 6 is a front elevation view, flattened, of the fifth tube member of the moon phase device.
Figure 7:
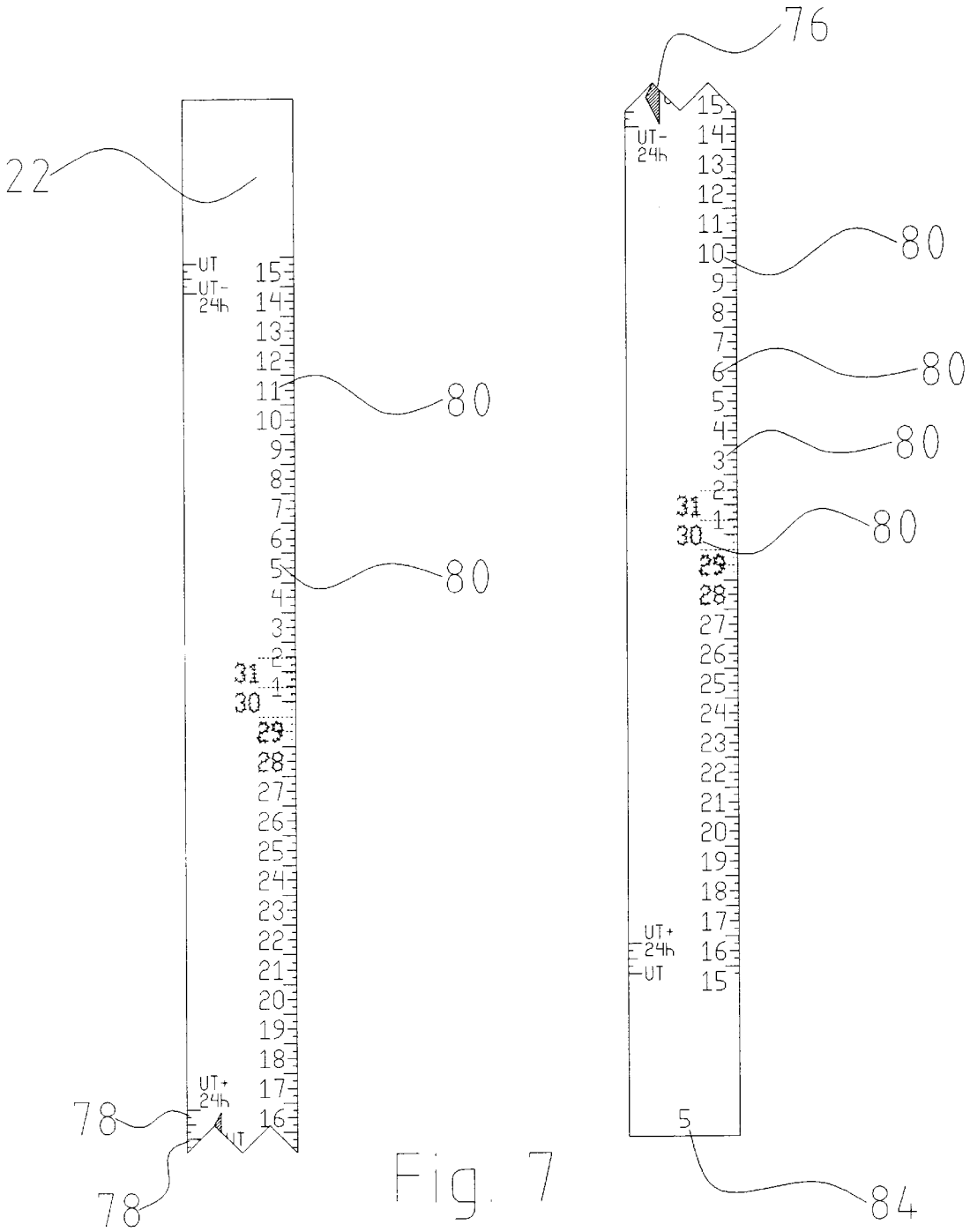
FIG. 7 is a front elevation view of the sixth tube member of the moon phase device.

Referring now to the drawings, it is seen that the moon phase device of the present invention, generally denoted by reference numeral 10, is comprised of a first tube member 12, a second tube member 14, a third tube member 16, a fourth tube member 18, a fifth tube member 20 and a sixth tube member 22. As seen each tube member 12, 14, 16, 18, 20, and 22 is an elongate member that has a generally rectangular shape.

As seen, the first tube member 12 has a first side 24 and a second side 26. The first side 24 of first tube member has moon phase indicia 28 thereon that pictorially represent the various phases of the moon. The second side 26 of the first tube member 12 has a plurality of thousands year indicia 30 thereon to numerically represent a particular thousands of a year. The thousands year can correspond to a BC year wherein the particular thousands year indicia will have a "BC" indicia corresponding thereto and will also correspond to either an old style date (before Oct. 15, 1582) wherein the thousands indicia "1" will be accompanied by the indicia "OS" or a new style date (on or after Oct. 15, 1582) wherein the thousands indicia "1" will be accompanied by the indicia "NS." Each of the plurality of thousands year indicia 30 will be in one of five colors (for purposes of illustration, different hatch markings have been placed on the various indicia in FIGS. 2–8, such that each particular hatch marking corresponds to a unique color of that indicia. The particular color is not important, only the difference in colors between the selections of one tube member and the indicator of the next tube member).

The second tube member 14 has a third side 32 and a fourth side 34. The third side 32 of second tube member 14 has a first indicator 36 for selecting a respective one of the thousands year indicia 30. The fourth side 34 of the second tube member 14 has a plurality of hundreds year indicia 38 thereon to numerically represent a particular hundreds of a year. As seen, the second tube member 14, by being generally triangular, has three faces 40*a*, 40*b*, and 40*c*, and each of the three faces 40*a*, 40*b*, and 40*c* has a third side 32 with a first indicator 36 thereon and a fourth side 34 with a plurality of hundreds year indicia 38 thereon. As seen, the first indicator 36 on the first face 40*a* is of a different color relative to the first indicator 36 on the second face 40*b* and the first indicator 36 on the third face 40*c* is of a different color than the first indicator 36 on the first face 40*a* and the first indicator 36 on the second face 40*b*. If the second tube member 14 is flipped, two more first indicators 36 will be present, each of a different color relative to all other first indicators 36.

The third tube member 16 has a fifth side 42 and a sixth side 44. The fifth side 42 of third tube member 16 has a second indicator 46 for selecting a respective one of the hundreds year indicia 38. The sixth side 44 of the third tube member 16 has a plurality of tens year indicia 48 thereon to numerically represent a particular tens of a year. As seen, the third tube member 16, by being generally triangular, has three faces 50*a*, 50*b*, and 50*c*, and each of the three faces 50*a*, 50*b*, and 50*c* has a fifth side 42 with a second indicator 46 thereon and a sixth side 44 with a plurality of tens year indicia 48 thereon. As seen, the second indicator 46 on the first face 50*a* is of a different color relative to the second indicator 46 on the second face 50*b* and the second indicator 46 on the third face 50*c* is of a different color than the second indicator 46 on the first face 50*a* and the second indicator 46 on the second face 50*b*.

The fourth tube member 18 has a seventh side 52 and an eighth side 54. The seventh side 52 of fourth tube member 18 has a third indicator 56 for selecting a respective one of the tens year indicia 48. The eighth side 54 of the fourth tube member 18 has a plurality of year indicia 58 thereon to numerically represent a particular single digit of a year. As seen, the fourth tube member 18, by being generally triangular, has three faces 60*a*, 60*b*, and 60*c*, and each of the three faces 60*a*, 60*b*, and 60*c* has a seventh side 52 with a third indicator 56 thereon and an eighth side 54 with a plurality of year indicia 58 thereon. As seen, the third indicator 56 on the first face 60*a* is of a different color relative to the third indicator 56 on the second face 60*b* and the third indicator 56 on the third face 60*c* is of a different color than the third indicator 56 on the first face 60*a* and the third indicator 56 on the second face 60*b*. If the fourth tube member 18 is flipped, two more third indicators 56 will be present, each of a different color relative to all other third indicators 56.

The fifth tube member 20 has a ninth side 62 and a tenth side 64. The ninth side 62 of fifth tube member 20 has a fourth indicator 66 for selecting a respective one of the year indicia 58. The tenth side 64 of the fifth tube member 20 has a plurality of months indicia 68 thereon to represent a particular month. As seen, the fifth tube member 20, by being generally triangular, has three faces 70*a*, 70*b*, and 70*c*, and two of the three faces 70*a*, and 70*b* have a ninth side 62 with a fourth indicator 66 thereon and a tenth side 64 with a plurality of months indicia 68 thereon. As seen, the fourth indicator 66 on the first face 70*a* is of a different color relative to the fourth indicator 66 on the second face 70*b*.

The sixth tube member 22 has an eleventh side 72 and a twelfth side 74. The eleventh side 72 of sixth tube member 22 has a fifth indicator 76 for selecting a respective one of the month indicia 68. As seen, the fifth indicator 76 has a plurality of gradations 78 thereon, each corresponding to a particular time zone, the center being universal time. The twelfth side 74 of the sixth tube member 22 has a plurality of numbers 80 to represent a particular day of the month.

In order to use the moon phase device 10 of the present invention, the second tube member 14 is moved so that the first indicator 36 is aligned with the thousands year indicia 30 for the thousands year that is of interest. The color of the first indicator 36 must match the color of the thousands year indicia 30 that is selected. If necessary, the second tube member 14 is either turned or flipped so that the face 40*a*, 40*b*, or 40*c* of the second tube member 14 that has the particular color of the first indicator 36 desired, is positioned adjacent the first tube member 12 allowing the first indicator 36 to align with the desired thousands year indicia 30.

The third tube member 16 is moved so that the second indicator 46 is aligned with the hundreds year indicia 38 for the hundreds year that is of interest. The color of the second indicator 46 must match the color of the hundreds year indicia 38 that is selected. If necessary, the third tube member 16 is turned so that the face 50*a*, 50*b*, or 50*c* of the third tube member 16 that has the particular color of the second indicator 46 desired, is positioned adjacent the second tube member 14 allowing the second indicator 46 to align with the desired hundreds year indicia 38.

The fourth tube member 18 is moved so that the third indicator 56 is aligned with the tens year indicia 48 for the tens year that is of interest. The color of the third indicator 56 must match the color of the tens year indicia 48 that is selected. If necessary, the fourth tube member 18 is turned or flipped so that the face 60*a*, 60*b*, or 60*c* of the fourth tube member 18 that has the particular color of third indicator 56 desired, is positioned adjacent the third tube member 16 allowing the third indicator to align with the desired tens year indicia 48.

The fifth tube member 20 is moved so that the fourth indicator 66 is aligned with the year indicia 58 for the single digit of the year that is of interest. The color of the fourth indicator 66 must match the color of the year indicia 58 that is selected. If necessary, the fifth tube member 20 is turned so that the face 70*a* or 70*b* of the fifth tube member 20 that has the particular color desired, is positioned adjacent the fourth tube member 18 allowing the fourth indicator 66 to align with the desired year indicia 58.

The sixth tube member 22 is moved so that the fifth indicator 76 is aligned with the month indicia 68 for the month that is of interest. If desired, the fifth indicator 76 is positioned so that a particular gradation 78 within the fifth indicator 76 is aligned with the month indicia 68 of interest to show data for a particular time zone ahead of or behind universal time. The day indicia 80 on the twelfth side 74 of the sixth tube member 22 are now positioned adjacent to the first side 24 of the first tube member 12 and the day indicia 80 that are positioned on the twelfth side 74 so as to correspond to the moon phase as indicated by the moon phase indicia 28 on the first side 24.

Figure 8:
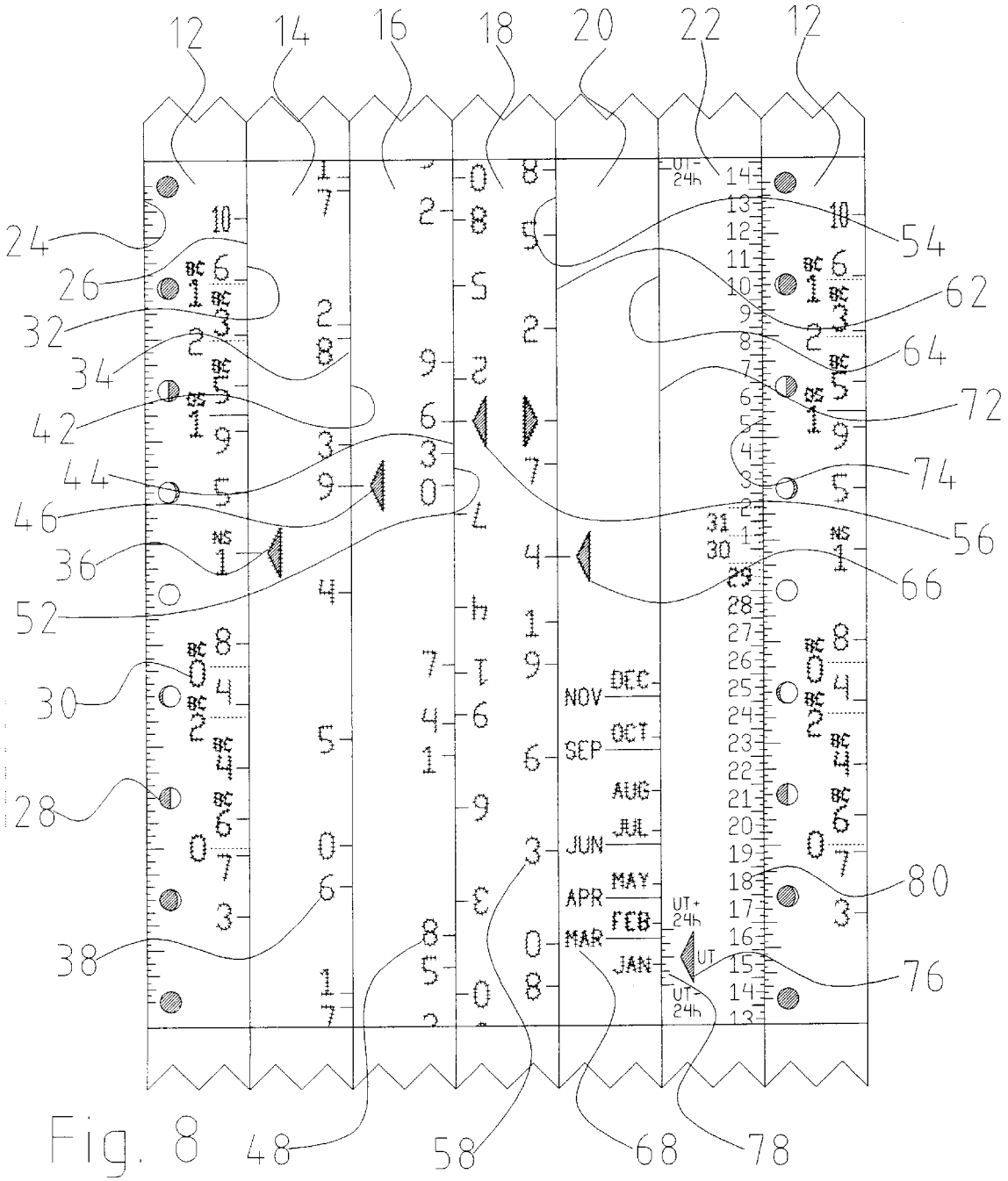
FIG. 8 is a front elevation view, flattened, of the moon phase device calculating the moon phases for January of 1964 for the time zone UT-6h.

By way of example, FIG. 8, illustrates the moon phase for the date of Jan. 29, 1964(UT-64) (the first tube member 12 being repeated for illustration purposes to show the sixth tube member 22 adjacent the first tube member 12).

In order to help position the tube members 12, 14, 16, 18, 20, and 22 relative to one another, it is desirable that tube members 12, 14, 16, 18, 20, and 22 be adapted to slide or otherwise move relative to each other. By way of example, at least one band 82 can be used to encompass the tube members 12, 14, 16, 18, 20, and 22 with the individual tube members 12, 14, 16, 18, 20, and 22 free to slide within the at least one band 82. If desired, each of the at least one band 82 can be fixedly attached to one of the tube members 12, 14, 16, 18, 20, and 22 (preferably but not necessarily the first tube member 12) so that it cannot be easily lost. As seen, each tube member 12, 14, 16, 18, 20, and 22 has a unique identifying indicia 84 thereon for assisting in adjacency placement of the tube members 12, 14, 16, 18, 20, and 22.

Alternately, the moon phase device 10 may be a series of dials instead of tubes, each of the dials operating in similar fashion to that of the tubes.

While the invention has been particularly shown and described with reference to an embodiment thereof, it will be appreciated by those skilled in the art that various changes in form and detail may be made without departing from the spirit and scope of the invention.

I claim:

1. A moon phase device, for determining the moon phase of a particular date, comprising:

a first member having a first side with a plurality of moon phase indicia thereon and a second side having a plurality of thousands year indicia thereon;

a second member, having a third side with a first indicator thereon for selecting a respective one of the thousands year indicia and a fourth side having a plurality of hundred year indicia thereon, adapted to move relative to the first member;

a third member, having a fifth side with a second indicator thereon for selecting a respective one of the hundreds year indicia and a sixth side having a plurality of tens year indicia thereon, adapted to move relative to the second member;

a fourth member, having a seventh side with a third indicator thereon for selecting a respective one of the tens year indicia and an eighth side having a plurality of year indicia thereon, adapted to move relative to the third member;

a fifth member, having a ninth side with a fourth indicator thereon for selecting a respective one of the year indicia and a tenth side having a plurality of month indicia thereon, adapted to move relative to the fourth member; and a sixth member, having a eleventh side with a fifth indicator thereon for selecting a respective one of the plurality of month indicia and a twelfth side having a plurality of day indicia thereon adapted to correspond with a respective one of the moon phase indicia, adapted to move relative to the fifth member.

2. The moon phase device as in claim 1 wherein the first member, the second member, the third member, the fourth member, the fifth member, and the sixth member each have at least one face that is generally rectangular.

3. The moon phase device as in claim 1 wherein the first member, the second member, the third member, the fourth member, the fifth member, and the sixth member are each generally triangular tubes.

4. The moon phase device as in claim 3 further comprising at least one band such that each of the first member, the second member, the third member, the fourth member, the fifth member, and the sixth member are disposed within the at least one band.

5. The moon phase device as in claim 3 wherein the first member, the second member, the third member, the fourth member, the fifth member, and the sixth member are disposed within the at least one band are generally arranged in a circular orientation.

6. The moon phase device as in claim 1 further comprising at least one band such that each of the first member, the second member, the third member, the fourth member, the fifth member, and the sixth member are disposed within the at least one band.

7. The moon phase device as in claim 6 wherein the first member, the second member, the third member, the fourth member, the fifth member, and the sixth member are disposed within the at least one band are generally arranged in a circular orientation.

8. The moon phase device as in claim 1 wherein the thousands year indicia represent both BC and AD years.

9. The moon phase device as in claim 1 wherein the particular date includes both old style dates before Oct. 15, 1582, and new style dates on or after Oct. 15, 1582.

10. The moon phase device as in claim 1 wherein the fifth indicator has a plurality of gradations thereon.

* * * * *